US006378925B1

(12) United States Patent
Greenlee

(10) Patent No.: US 6,378,925 B1
(45) Date of Patent: Apr. 30, 2002

(54) HAND GRIP ORTHOSIS

(76) Inventor: Peter A. Greenlee, 1650 Harvard St. NW, #704, Washington, DC (US) 20009

( * ) Notice: Subject to any disclaimer, the term of this patent is extended or adjusted under 35 U.S.C. 154(b) by 0 days.

(21) Appl. No.: 09/439,341

(22) Filed: Nov. 15, 1999

Related U.S. Application Data

(63) Continuation-in-part of application No. 08/949,206, filed on Oct. 10, 1997, now abandoned.

(51) Int. Cl.[7] ..... A45C 13/26; B65D 33/06

(52) U.S. Cl. ..... 294/171; 294/137

(58) Field of Search ..... 294/137, 149, 294/153, 156, 158, 166, 170, 171, 25, 147; 16/114.1, 406, 422, 425, 428; 229/117.09, 117.19; 383/6, 13, 25; D9/434, 455

(56) References Cited

U.S. PATENT DOCUMENTS

| | | | | | |
|---|---|---|---|---|---|
| 3,268,134 | A | * | 8/1966 | Baston et al. | 294/147 X |
| 3,912,140 | A | * | 10/1975 | Franges | 294/171 X |
| 4,262,385 | A | * | 4/1981 | Norman | 294/171 X |
| 4,932,702 | A | * | 6/1990 | Sweeny | 294/171 |
| 5,364,148 | A | * | 11/1994 | Bartocci | 294/171 |
| 5,487,582 | A | * | 1/1996 | Bourgeois et al. | 294/171 X |
| 5,511,445 | A | * | 4/1996 | Hildebrandt | 294/171 X |
| 5,658,029 | A | * | 8/1997 | Franko | 294/171 |
| 5,803,522 | A | * | 9/1998 | Lisbon | 294/149 X |

FOREIGN PATENT DOCUMENTS

| | | | | |
|---|---|---|---|---|
| EP | 85524 | * | 8/1983 | 294/171 |
| GB | 2135179 | * | 8/1984 | 294/171 |
| GB | 3509679 | * | 9/1986 | 294/171 |
| GB | 2253995 | * | 9/1992 | 294/171 |

* cited by examiner

*Primary Examiner*—Johnny D. Cherry
(74) *Attorney, Agent, or Firm*—Miles & Stockbridge P.C.; John C. Kerins

(57) ABSTRACT

A container handle engaging device is provided which has a first and a second panel formed of a core layer of resilient material, the first and second panel being folded along abutting inner edges to an operating position where the panels are mutually parallel, and wherein a handle may be captured in the fold. Third and fourth panels may be provided, in order to increase comfort and to promote the use of a proper gripping position for the hand. A method of distributing advertising materials at point-of-purchase locations, using the device, is also provided.

15 Claims, 6 Drawing Sheets

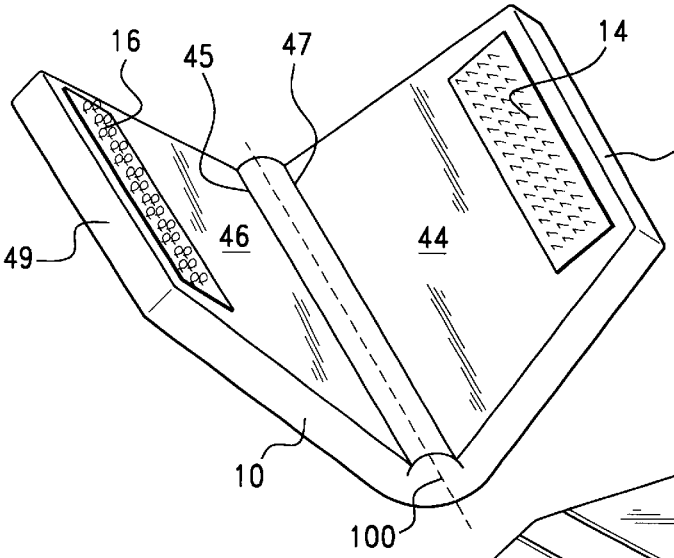
FIG. 1
FIG. 2B
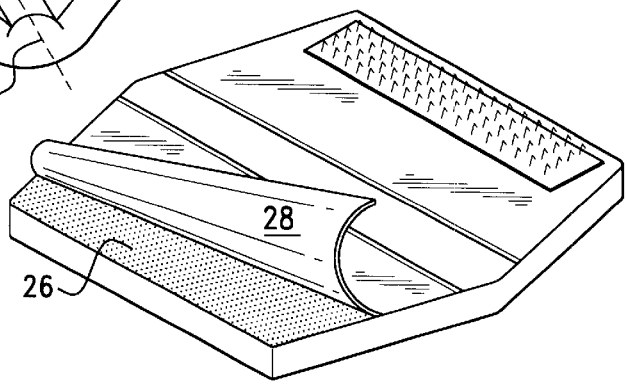
FIG. 2A
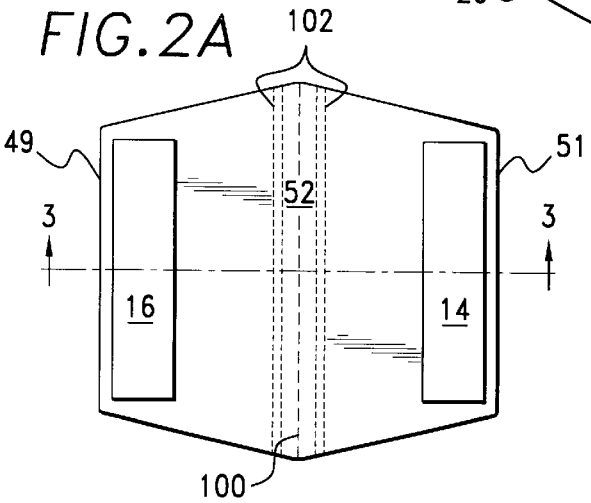
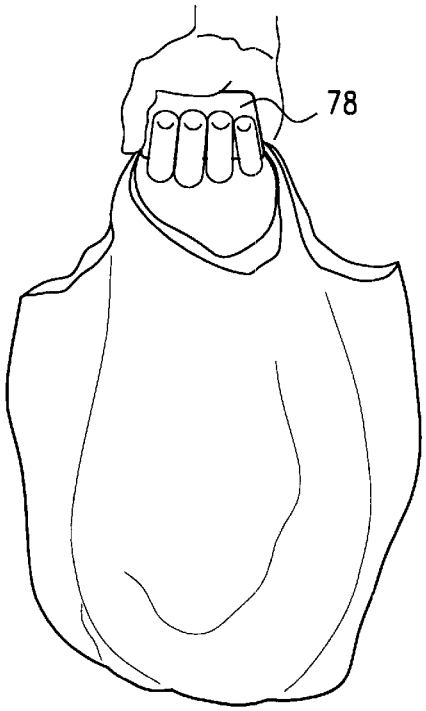
FIG. 3B
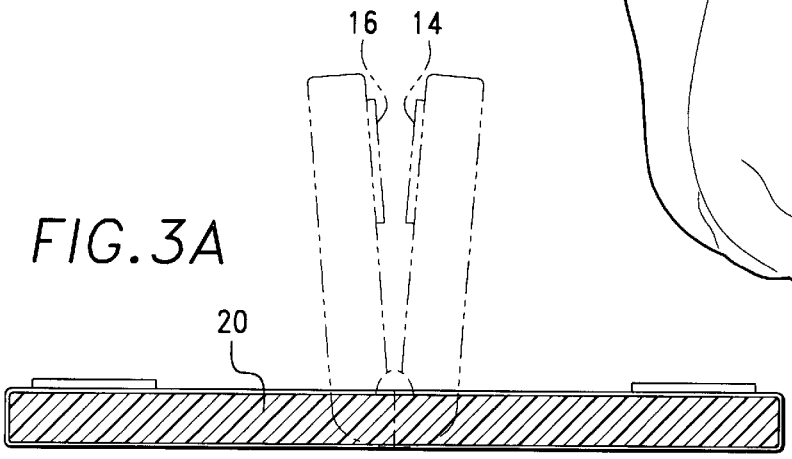
FIG. 3A

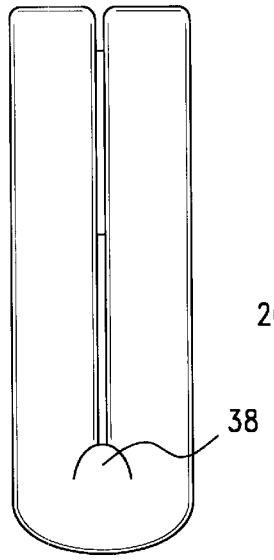
FIG. 4A
FIG. 4B
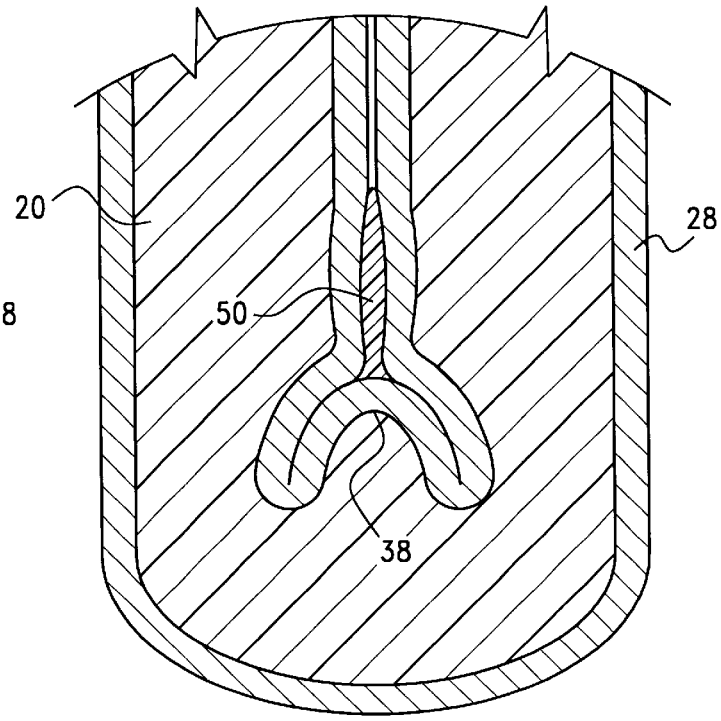
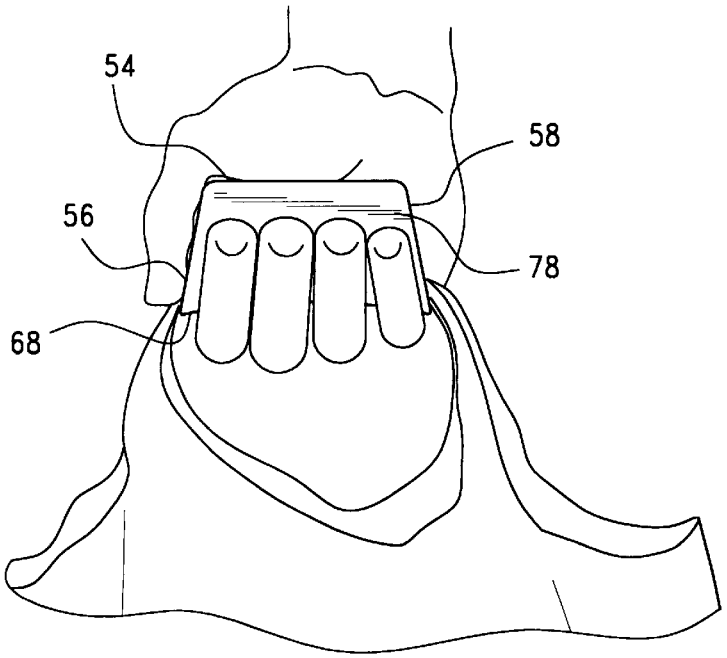
FIG. 5

HAND GRIP ORTHOSIS

CROSS-REFERENCE TO RELATED APPLICATION

This application is a continuation-in-part of application Ser. No. 08/949,206, filed Oct. 10, 1997, now abandoned.

BACKGROUND OF THE INVENTION

1. Field of the Invention

The present invention relates to a device or an orthosis for supporting and assisting the hand in the grasping of handled objects.

2. Description of Related Art

The grasping of bag handles, or handles of other containers for carrying materials, or other objects having handles, has been problematical for many people, as pressure generated on the hand by the load attached to the handles creates discomfort, and, sometimes, extreme discomfort and injury to users. Plastic film grocery bags, for example, have integral handles made of the same thin flexible material from which the bag is formed. These handles, when grasped, gather, contract, or compress such that the load is distributed over only a thin area within the grip of the user. Paper bags generally have thin, ropelike handles which similarly concentrate forces and pressure along only a thin strip within the user's grasp. Other containers or objects may employ wire metal handles, which similarly concentrate force and pressure at a narrow area.

As a result of load pressure, transferred by the handles, the handles cut into the surface of the hand. They cut deeply enough into the gripping surfaces of the hand to adversely impact the sensory nerves in many instances. The impact traumatizes the nerves and causes pain. The pain and attendant discomfort will, after a very short time, cause the grasping hand to collapse or deform from a position of function into a position of injury. In the position of injury, the hand assumes a hook or claw-like posture. In the hook or claw-like posture, the fingers of the hand are extended with the last phalanx of each curling into a hook or claw-like shape. It is this shape upon which the handles come to rest. Often the handles will rest upon only three of the four hooked fingers. This adds to the degree of trauma exerted upon the unprotected, unsupported hand.

Protecting the grasping hand is not a new problem. Many attempts have been made to solve this problem in the past. Perhaps the most common solution has been to use padding between the hand and the object gripped. A typical application of the padding solution is the glove. However, most gloves used in grasping or gripping applications serve only to protect the hand against abrasion. They are not intended to, nor do they, support, align, prevent or correct deformities of the gripping hand. Nor do they serve as isometric means.

Heretofore, orthoses have been used remedially for therapeutic purposes to support, align, prevent, or correct deformities or to improve the function of moveable parts of the body. Examples of the therapeutic use of orthoses to restore function to nonfunctional body parts such as the hand are: "Inflatable Palmar Bladder", Mann and Mann, U.S. Pat. No. 5,531,668, and "Inflatable Hand Orthosis", Stern, U.S. Pat. Nos. 5,382,837, and 5,593,369.

Other types of devices are used to protect and improve the function of the hand. An example is: "Hand protector," Melone, U.S. Pat. No. 5,572,738. It is intended exclusively for the therapeutic restoration, support and protection of the injured nonfunctional hand. Physically, the device consists of an immobilizing cast surrounding the hand from the wrist to the knuckles.

The "Shopping Bag Handle Grip", Eden, U.S. Pat. No. 5,507,542, is a device for carrying shopping bags. It is comprised of a handle upon which the handles of shopping bags are placed for carrying. However, it is bulky. It neither protects or supports the gripping hand. Nor does it serve otherwise to provide grip enhancing means.

The "Hand Saver", Stauffer, U.S. Pat. No. 3,800,361, is a device for carrying shopping bags, cartons and the like having handles of cord-like material. It is comprised of a body of flexible, resilient material between which at least one pair of separated, confronting surfaces for grippingly receiving a cord like handle are located. It is not easy to use. Handles have to be forced into it, using both hands, for application or use. It is not safe to use because it depends solely upon the resiliency of the device, as opposed to bracing means and fasteners to retain handles therein. It has no fasteners and therefore cannot be affixed to objects trapped therein. Consequently, when it is released from the grip, when set down, the handles lodged therein will be pulled free by the weight of the bag load thereon. As a result, the bag will collapse. When the bag collapses, it will dump its contents. In addition, it does not provide means for bracing the transverse arch. It does not provide means for bracing the longitudinal arch. It does not provide means for bracing the thumb or for bracing the heel of the hand. Nor does it provide means for bracing the palm. It does not provide isometric means. This device does not provide stabilizing means. It does not provide trapping means. It does not provide means for either a lateral shield or an energy absorbent dome. Nor does it provide braking means or fastening means.

The "Isometric Hand Exercising System", Blackmore, U.S. Pat. No. 5,611,755, is an apparatus that provides for isometric means and involves the hands. However, it is used as isometric means solely for exercise of the hand and forearms. It requires simultaneous movement of both hands to achieve isometric involvement. Isometric muscle involvement is focused on arm and forearm development as opposed to enhancement of the grip of the hand.

The "Plastic Bag Handle", Halpin & Okuchi-Halpin, U.S. Pat. No. D367,817, is a design of a handle for carrying plastic bags. It is comprised of a tubular structure with a slit running lengthwise down the side. It most resembles a piece of garden hose split down the side. The slit is the means by which plastic bag handles are inserted therein. This device does not have braking means. Nor does it have isometric means or means for a thumb brace. It does not brace the heel of the hand nor does it have isometric means. This design does not provide for an energy absorbent dome nor does it have fastening means. Neither does it provide bracing means for the palm, the longitudinal arch nor the transverse arch.

"Handle", Sweeney, U.S. Pat. No. D325,156, is a design of a handle for carrying plastic bags. "Plastic Bag Handle", Salazar, U.S. Pat. No. D374,621, is also a design of a handle for carrying plastic bags. However, neither supports the gripping hand. Neither shields the hand from lateral forces. Neither provides a friction brake. Neither provides bracing means for the transverse arch or the longitudinal arch. Also neither provides bracing means for the heel of the hand or the thumb. Further, neither provides bracing means for the palm. Nor does either provide for isometric means or provide for an energy absorbent dome. Clearly, both designs possess the same deficiencies as "Plastic Bag Handle" cited previously.

Unpatented devices, used to solve the hand trauma problem, commonly use the solution consisting of the substitution of a larger handle for a smaller one. "Bag Grabber", created by Andy Haynes of Nashville, Tenn. (N.Y. Times, May 15, 1996, P. c2) is one such device. It consists of a hard plastic handle that has carrying hooks protruding from the bottom. Another is "shipping Bag Carrier", a product of Magic American Corp. of Cleveland, Ohio. It consists of a hard plastic handle with a single hook, for bag carrying, protruding from the bottom. Still another is the "Cardboard Tube Grip". It is a device which includes a handle consisting of a piece of cardboard tube through which a heavy gauge wire has been run and turned down to form short arms at each tube end. These arms have hooks at their ends over which bag handles are placed.

The "Shopping Bag Carrier", "Cardboard Tube Grip", and "Bag Grabber", all fail to provide means for bracing, the thumb, the longitudinal arch, the transverse arch, the palm, or the heel of the hand. None of the above mentioned has means for isometric engagement stabilization or an energy absorbent dome. Further, none of them provide trapping means or braking means.

The Handle Wrap is a device comprised of a piece of material which is attached to the handles of some pieces of luggage. It is used by wrapping and fastening same around said handles to enlarge the surface area presented for grasping. It combines both handle surface areas into one, thereby providing an increased handle surface area over which to transfer load pressure. Accordingly, its primary function is to increase handle surface area over which load force can be disbursed. However, it provides little more protection than a glove nor does it otherwise support the grasping hand.

The "Bag Grabber", "Shopping Bag Carrier" and "Cardboard Tube Grip" are also dangerous to use. For example, if a handle carried in such devices breaks, it will come free. When it does, the bag carried, will tip and the contents of it spill out. In addition, if the tube, of the "Cardboard Tube Grip" fractures, the wire frame running through it will also fail. In failing, the wire will bend down upon the hand and painfully squeeze it. The squeezing will result in pain. The pain will cause the holder of the failed device to release it. As a result, the bag will be dropped and damage the contents of it. All told, the disadvantages of the "Bag Grabber", "Cardboard Tube Grip" and "Bag Carrier" negate any advantage gained through their use. These devices fail to provide a satisfactory solution to the hand trauma problem. Further, none of them possesses physically novel features which produce new and unexpected results. None of the devices set forth above achieves a solution to the hand trauma problem. They do not use either a method of, or provide a device for, protecting and supporting the gripping hand. Neither do they present either a method of or device for support and protection of the grasping, gripping hand. That is, none of the solutions presented by these devices involves using an orthosis to prevent trauma induced deformation of the hand.

At present, orthoses and other devices are used exclusively to address the non-functional injured hand. Their method of use is remedial and reactive to existing conditions. They are not used prophylactically to defend against or prevent injury in the first instance. Rather, they are used as a means of restoration of function to injured body parts. Such devices do not currently address the relationship of the longitudinal and transverse arches to maintenance of the grip because the non-functional injured hand cannot, by definition, function in a normal manner. Accordingly, orthoses for the hand have not previously been based on any recognition that trauma to the sensory nerves of the hand is directly related to collapse or deformation of said arches. Neither are orthoses currently intended to support, protect or maintain the arches. Consequently, existing orthoses for the hand do not provide means for correcting or preventing a hand trauma caused by grasping objects such as handles of plastic grocery bags.

Current orthoses for the hand and methods of use thereof do not facilitate maintenance of the hand in a functional posture. Their sole purpose is to provide remedial therapy for the non-grasping, non-functional, injured hand. Therefore, they do not, and, in fact, cannot, facilitate maintenance of the grip of the hand as it grasps trauma-producing objects such as handles of plastic grocery bags.

SUMMARY OF THE INVENTION

In view of the aforenoted disadvantages and problems or shortcomings of devices in the prior art, the present invention has been developed. The principal objects and advantages provided by the present invention are as follows:

(a) to provide an orthosis for supporting and protecting the grasping hand from trauma;

(b) to provide an orthosis that is inexpensive and simple to manufacture;

(c) to provide an orthosis that is easy to use;

(d) to provide an orthosis that is easy to store and transport;

(e) to provide an orthosis that can be made in various sizes;

(f) to provide an orthosis that is safe for household applications;

(g) to provide an orthosis that is easily packaged;

(h) to provide an orthosis that can be made in different colors;

(i) to provide an orthosis which can hold several objects simultaneously;

(j) to provide an orthosis that functions as a handle brake;

(k) to provide an orthosis that can be made of energy absorbent, force disbursing material;

(l) to provide an orthosis that can be covered;

(m) to provide an orthosis which is waterproof;

(n) to provide an orthosis which is durable;

(o) to provide an orthosis that can align, prevent, or correct deformities of the hand;

(p) to provide an orthosis that functions as a handle trap;

(q) to provide an orthosis that improves the function of movable parts of the body;

(r) to provide an orthosis which protects the sensory nerves of the hand;

(s) to provide an orthosis which serves as means for bracing both the longitudinal and transverse arches;

(t) to provide an orthosis which functions as a means for stabilizing and balancing both the load carried and the carrier;

(u) to provide an orthosis which has a prophylactic function;

(v) to provide an orthosis which is firm yet resilient;

(w) to provide an orthosis which prevent disorders of the hand which impair vocational capacity;

(x) to provide an orthosis which protects the hand from lateral and vertical forces, and (y) to provide an orthosis that can be repeatedly used.

It is a further principal object of the present invention to provide a gripping device to be used in connection with a handled object, such as a container with handles extending therefrom, which has sufficient surface area for the application of text or graphics, such as, for example, commercial advertising.

It is yet a further important object of the present invention to provide an advertising distribution system and method, in which a device of the present invention is employed as point-of-purchase advertising that is distributed to customers and remains with the customer.

BRIEF DESCRIPTION OF THE DRAWINGS

FIG. 1 is a perspective view of the device according to a first preferred embodiment of the invention.

FIG. 2A is a plan view showing a front side of the device.

FIG. 2B is a perspective view of the device with a cover shown in a partially pulled back position, to reveal the core portion.

FIG. 3A is a cross-sectional view of the device taken along section line 3—3 of FIG. 2A, and further showing the device, near a closed position thereof, in broken lines.

FIG. 3B illustrates the device as used with a grocery bag.

FIG. 4A is a side elevation view of the device in a closed position.

FIG. 4B is an exploded sectional view of the area of the first fold of the device.

FIG. 5 is a front view demonstrating how the device engages a closed palm and bag.

DETAILED DESCRIPTION OF THE PREFERRED EMBODIMENT

Figure 6:
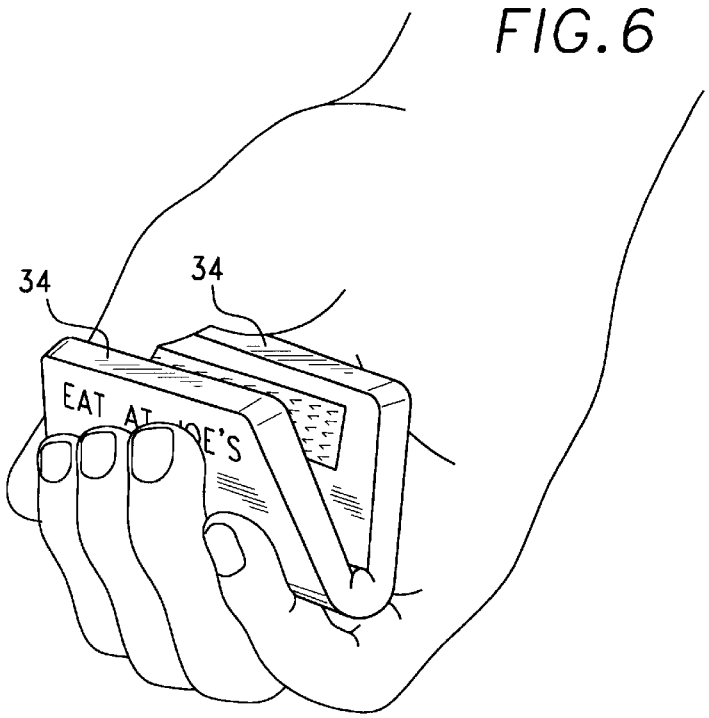
FIG. 6 is a view showing the device in an engaged palm.
Figure 7:
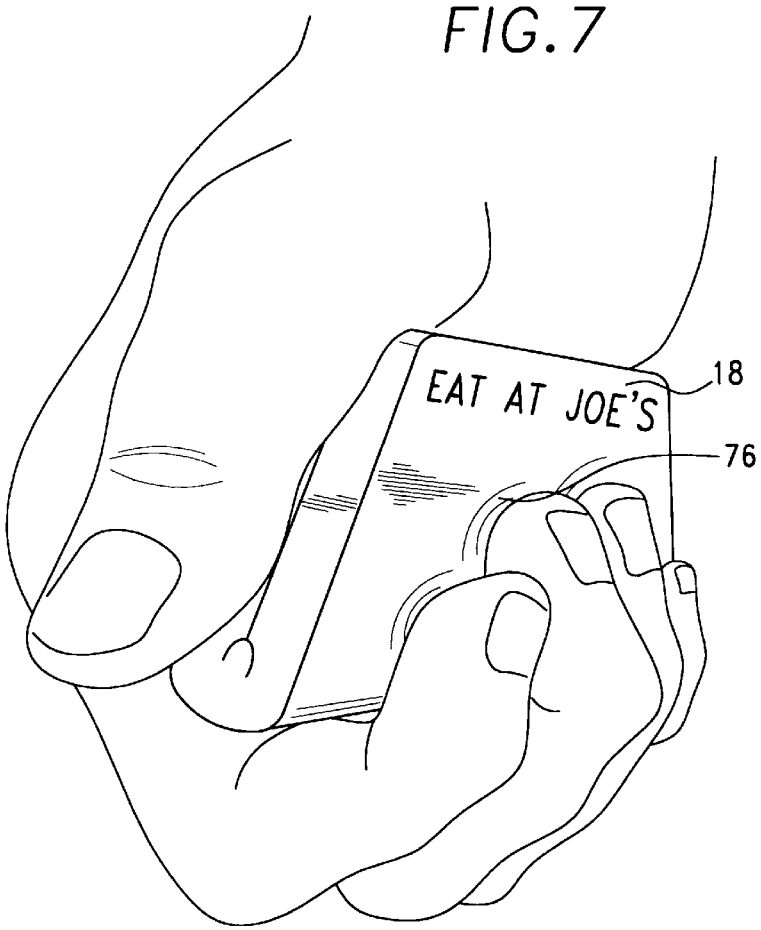
FIG. 7 is a view showing the device in a fully engaged closed palm.
Figure 8:
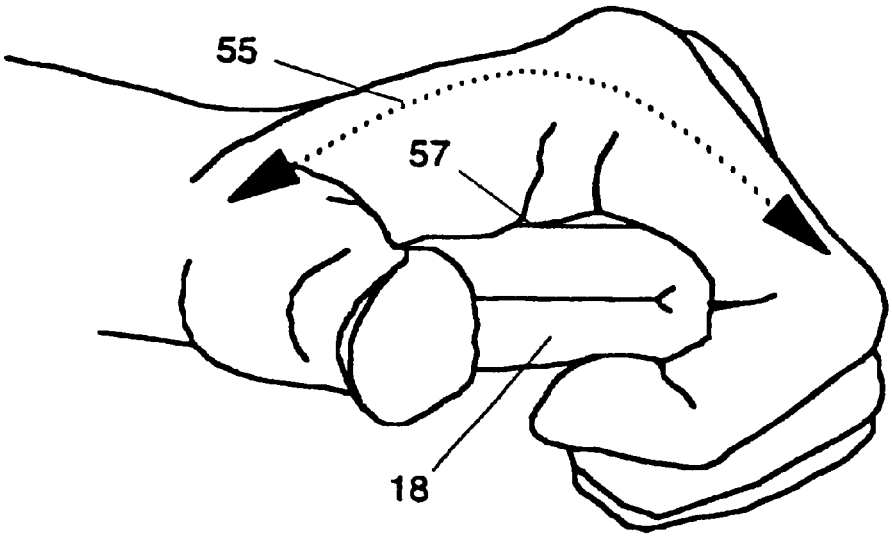
FIG. 8 is a view of a hand engaging the device illustrating that a longitudinal arch brace and a palm brace are formed by the device.
Figure 9:
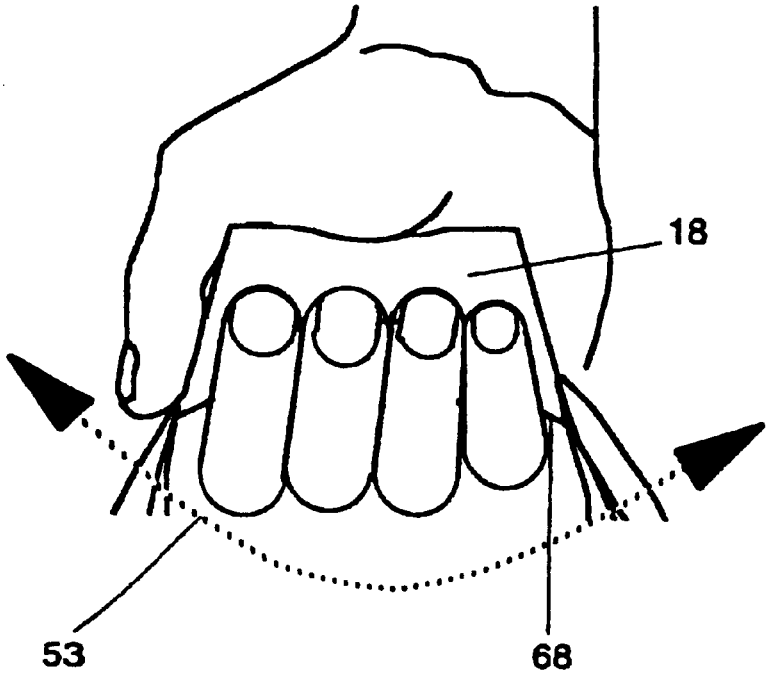
FIG. 9 is a view of a hand gripping the device and illustrating the formation of a transverse arch brace and a lateral shield.

FIGS. 1–9 illustrate, in various views and positions, the handle gripping device or orthosis 10 of the present invention. The device 10 in this embodiment comprises first and second panels 44, 46, respectively. The panels 44, 46 are preferably sized so as to fit, when folded upon each other (see FIGS. 3A, 4A, 4B) into an operational configuration, in the palm of a human hand (see FIGS. 3B, 5, 6, 7, 8 and 9).

Panels 44, 46 are preferably formed from a single sheet, or multiple laminated sheets, of a resilient, energy absorbent material, such as ethylene vinyl acetate (EVA) foam. Expanded polypropylene (EPP) or other resilient foamed polymer materials may alternatively be used. The panels, in order to provide improved fit into the hand of the user, are preferably trapezoidal in shape, with the longer base sides 45, 47 of the two panels joining or meeting at a center line 100 of the device. Thus configured, the device 10, when in a flat, open position, is substantially hexagonal in shape. When folded along the centerline 100 into its operational position, the longer base sides 45, 47 provide a wide gripping length or area for the fingers of the hand, while the shorter parallel edges 49, 51 of the panels result in the panels tapering to a narrower width in order to better be accommodated in the palm of hand.

The centerline area 100 of the device may be pre-scored or pre-creased as indicated by score lines 102 in FIG. 2A, in order to facilitate the bending of the device at precisely the desired location. Alternatively, the energy absorbent material selected for use may be sufficiently pliable that simple manipulation of the two panels will readily form the bend or fold at the desired location. If desired, the area at which the fold is to be made may be marked with simple indicia such as a fold line.

The energy absorbent material or core 26 from which the device is made may preferably have a cover layer 28 of a flexible polymeric material, which is laminated or otherwise adhered to the core material. FIG. 2B illustrates the device with the cover layer 28 partially pulled back to reveal the core material 26. The cover layer may provide a degree of water resistance, where that is seen to be desirable, and may prolong the useful life of the device by improving wear resistance. Where an EVA foam material is used as the core material, it is envisioned that no cover layer will be necessary.

Referring now to FIGS. 1, 3A, 4A and 4B, it can be seen that, when the device is folded from a flat, open position to a closed operational position in which the first and second panels are parallel and are substantially adjacent to each other, a portion of the central part of the device may deform, depending upon the bending characteristics of the material used, to produce an energy absorbing dome 38, which can aid in engaging the package handle material 50 (FIG. 4B) captured between panels 44, 46. This dome portion 38 may aid in substantially preventing the captured handle material from knifing through the resilient core material of which the panels are made, which would reduce the effectiveness of the core material as a cushioning and force dissipating medium. The formation of this energy absorbing dome is not, however, seen as being a critical feature of the device.

The device preferably has mating releasable fasteners, illustrated in FIG. 1 as a pair of strips 14, 16 of hook and loop fastening material. As seen in FIGS. 3A and 4A, these fasteners are joined together when the device is folded into its operational position. Releasable fasteners are preferred, in order to enable reuse of the device, however, more permanent fastening means, such as a pressure sensitive adhesive may be used, or the device may be provided without fastening means if deemed suitable for specific uses. A pressure sensitive adhesive can be applied to only one of the two panels to be joined, in that it will adhere directly to the surface of the opposing panel. It is thus realized that the device of the present invention can be provided, as desired, as a single use device, or as a repeat-use device.

The device 10 provides several unique functional advantages not present in known orthotic handle devices. As seen especially in FIGS. 5, 7, 8 and 9, the folded panels of the device fit in the palm of the hand, and the side edges of the panels provide a thumb brace area 56. The panel facing the palm provides a palm rest or palm brace surface 57, and the panel facing away from the palm provides a resilient surface 76 into which the user's fingers can be depressed in completing a correct grip. A transverse arch brace 53 and a lateral shield 68 are formed at the lower extent of the folded device 10. Further, a heel brace or rest surface 54 is provided by the outer edges 49, 51 of the folded device.

The device 10 also acts as a friction brake by engaging and holding the bag handles 50 with the inner portion of the resilient panel material, as can be seen in FIG. 4B. The open device is inserted through openings or loops formed by the bag (or other device or container) handles, and the panels are folded toward each other (FIG. 3A), and are fastened together to surround the upper portions of the handles. When the bag is lifted by the device 10, the grip pressure exerted by the user's hand compresses the inner surfaces of the panels against the bag handle material. Frictional forces combine with the pressure applied by the grip to firmly engage the bag handles. This provides a safety measure not found on other known grip assisting devices, in that, if the handle breaks at one side, the middle portion of the handle will remain gripped, thus permitting the user to maintain control of the bag.

Figure 10:
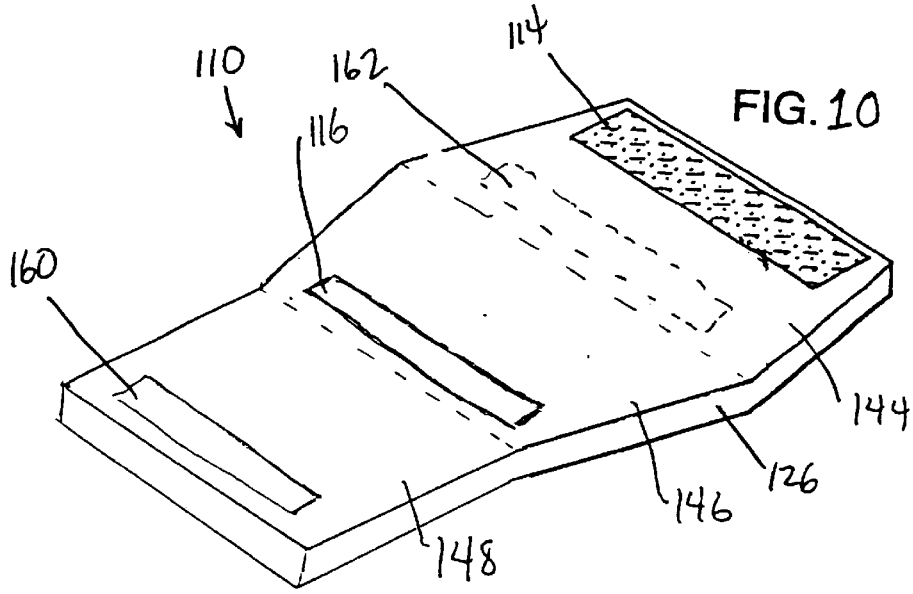
FIG. 10 is a perspective view of a second preferred embodiment of the device.
Figure 11:
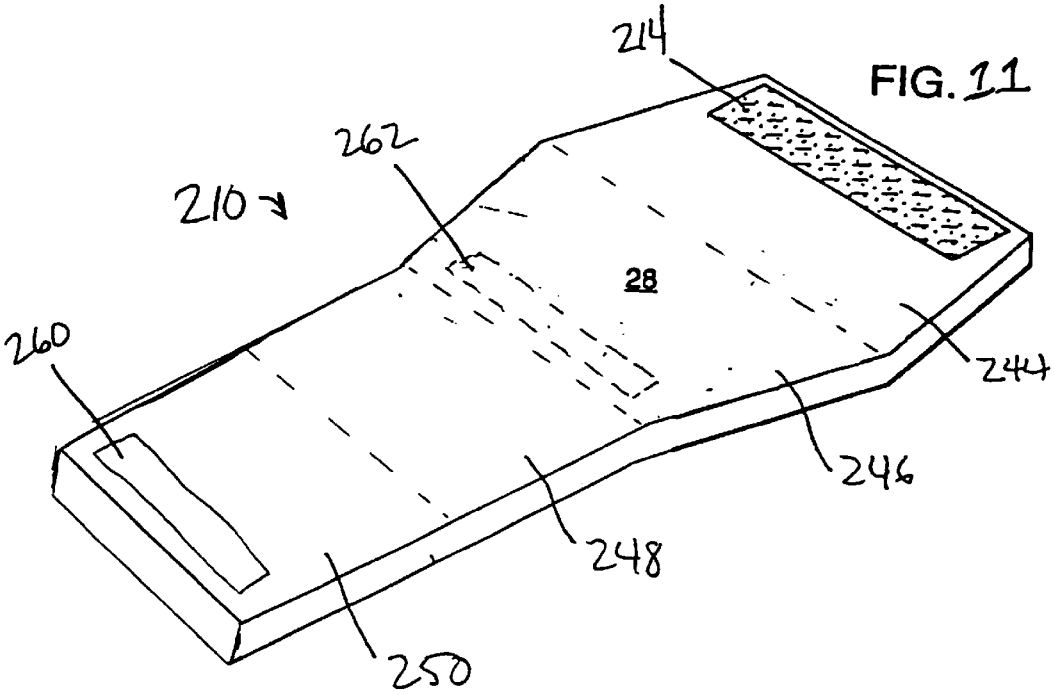
FIG. 11 is a perspective view of a further preferred embodiment of the device.
Figure 12:
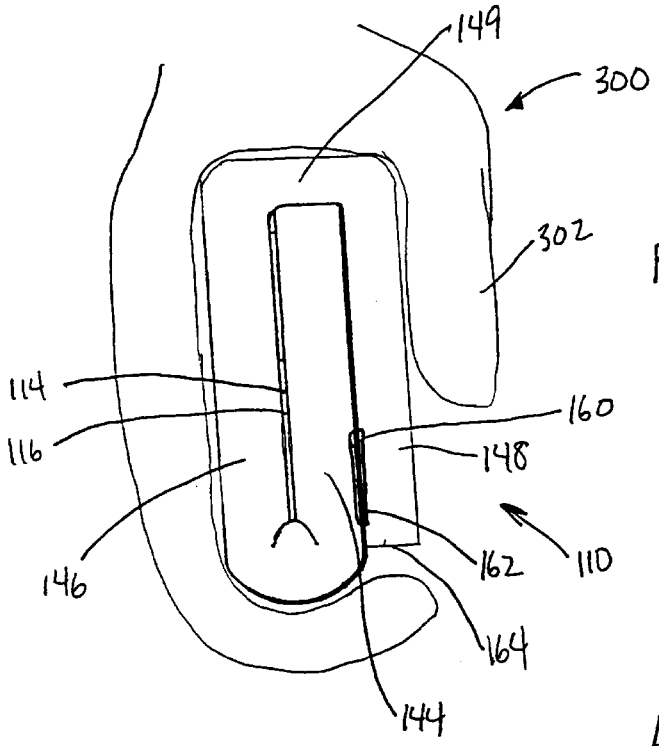
FIG. 12 is a side view of the FIG. 10 embodiment in a closed position.
Figure 13:
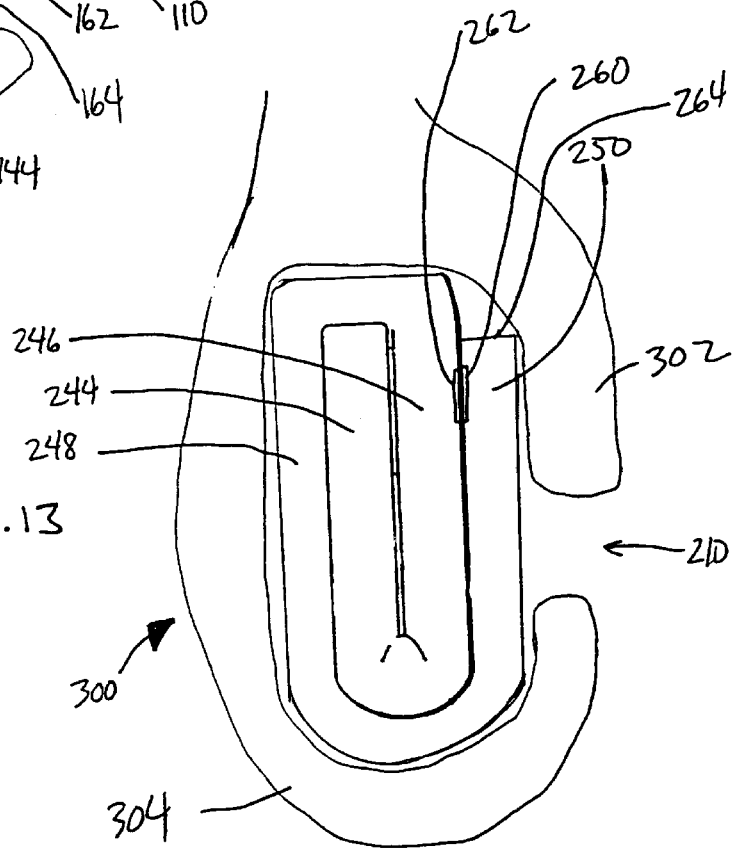
FIG. 13 is a side view of the FIG. 11 embodiment in a closed position.

Two further preferred embodiments are illustrated in FIGS. 10–13. These embodiments expand and improve upon the basic two panel devices illustrated in FIGS. 1–9. FIGS. 10 and 12 show a device 110 made up of first, second and third panel sections 144, 146, 148. FIGS. 11 and 13 show a device 210 made up of four panel sections 244, 246, 248, 250. These embodiments of the device may preferably be constructed of the same materials as is the device of FIG. 1. Because there will be additional panel sections to be folded over, the benefits of which will be discussed later, the initial thickness of the core layer 126 may be thinner than it is with the two panel configuration of FIG. 1. In general, for any of the two, three or four panel devices, the thickness of the core layer is preferably from about 1–10 mm, and, more preferably, from about 2–4 mm. The core layer can be a single sheet or ply, or may be made up of two or more laminated sheets or plies.

Turning now to FIGS. 12 and 13, it can be seen that the three panel embodiment 110 and the four panel embodiment 210 are folded into an operational configuration in much the same way as is the two panel device 10. The principal difference is that, after the first and second panels 144, 146, 244, 246 are folded to capture the bag handles (shown in FIGS. 3B, 4B), the additional panel or panels are further folded or wrapped around the first two panels. Turning back to FIGS. 10 and 11, when viewed in conjunction with FIGS. 12 and 13, it is to be noted that the fastening means in these two embodiments, again, preferably strips of hook-and-loop material 114, 116 (FIG. 10), may be positioned on the first and second panels to initially fasten these panels, and, in addition to, or instead of, those fastening strips, hook-and-loop fastener strips 160, 162 may be positioned on an upper surface of the third panel section 148 and a lower surface (the terms upper and lower being used only to connote that the strips will be placed on opposite surfaces of the device) of the first panel 144. These strips 160, 162 will come into mating engagement when third panel 148 is folded over first panel 144 (FIG. 12). Alternatively, the fastening means may be dispensed with in the three and four panel embodiments, if desired, as the gripping action itself will securely hold the device in the desired operating position.

When fasteners are employed on the four panel device 210 of FIGS. 11 and 13, again, fastening strips 214 (only one shown) may be positioned on first and second panels in the same manner as is done in the FIG. 1 device. In addition, or alternatively, hook-and-loop fastening strips 260, 262, may be provided on an upper surface of the fourth panel 250, and on the lower surface of the second panel 246. As can be seen in FIG. 13, these are the final two surfaces which are brought into contact in folding or wrapping the device into an operable configuration. Again, the fastening means may be omitted if desired in this embodiment.

The three panel and four panel devices 110, 210, provide significant advantages over the basic two panel device. Each of these embodiments aids in promoting a proper grip to be used in carrying the bag. In the three panel device 110, it can be seen in FIG. 12 that the presence of the third panel inherently urges the user to keep the thumb 302 in a proper gripping position, particularly when there is no fastening means provided near the distal end 164 of the third panel. In this embodiment, the third panel is wrapped over the first panel, but requires constant pressure by the thumb 302 and a proper wrapping of the hand 300 over the portion 149 of the third panel 148 extending across the top of the device, in order to maintain the device 110 in its proper operating position.

Similarly, the four panel device, particularly where no fastening means are employed at the distal end 264 of the fourth panel 250, promotes proper gripping of the device. This embodiment promotes especially the proper gripping by the fingers 304, in that the wrap of the fourth panel 250 around the interior panels is maintained by the gripping force of the fingers 304, and, to a limited extent, the thumb 302.

Both of these embodiments thus provide distinct advantages in decreasing the discomfort level of the user's hand, and further reducing the risk of possible injury. It would, of course, be possible to employ five or more panels in a device of this type; however, since the fifth panel would assume essentially the same position as does the third panel, in the operational configuration, no great advantage is presently seen in using five panels instead of three. If five panels are contemplated for the purpose of increasing the thickness of the device in the operational configuration, that could possibly be done with a three panel device using a thicker core material. The same applies to a six panel device. The sixth panel would assume essentially the same position as does the fourth panel in FIG. 13. As such, while it is possible to construct a six panel device, there is not seen to be any great advantage in doing so.

The device 10, 110, 210 of the present invention may advantageously be employed as a key element in a method and system for the distribution of advertising. The relatively large, flat surfaces of the panels of the device make the device extremely suitable for the placement of indicia, and, in particular, advertising graphics or copy. The method for distributing advertising thus comprises placing advertising indicia on one or more exposed surfaces of the device, distributing the devices to retail merchants, placing the devices at the point-of-purchase location, which in a supermarket, for example, is the check-out and bagging lane, and once purchased goods are bagged, positioning the device in its operating position around the handles of a bag, whereby at least a portion of the advertising indicia remains exposed, and relinquishing the bag with the device positioned thereon to the customer.

This method is seen as being a highly effective method for advertising, in that the device itself is relatively inexpensive, an the advertising space can thus be purchased at an affordable price. A key to the effectiveness of this advertising is that, because the device provides comfort to the person carrying the bag, a positive association and a positive experience will be made in the person's mind with the device, and with the message carried on the device.

The handle engaging device of the present invention can be outfitted or modified in numerous different ways, depending upon the expected target market and the expected manner of distribution, including whether the device will be a promotional "giveaway", or possibly a device that would be sold for its function both as a handle-engaging device and an auxiliary function. Examples of ways in which the device could be modified include providing flashing light displays or flowing light displays on the exposed portions of the panels. The device could further be provided with a display means for displaying electronically generated images. The placement of indicia on the panels could include the reproduction of black-and-white or color photographs.

The device can be provided with other embedded devices, such as a sound generator or music player, an electronic tag, a light source or system, an anti-theft/attack noise generator, a hand warmer, a fragrance/scent dispenser, a lotion dispenser, a display in the form of an electronic scrolling billboard, a radio receiver, a vibrator/massager, a television receiver, an electronic note pad (pen-and-display device), an aural locator beacon, a battery pack or battery system, which may be removable, a solar energy collector, a programmable graphic display generator/display. The device may also be augmented with a hand brace (that is not formed integrally with the device), a visual presentation tool (e.g., laser pointer), or an isometric exerciser.

While the invention has been described in conjunction with several specific embodiments, it is evident that alternatives, modifications and variations of the disclosed embodiments may be developed which do not depart from the spirit and scope of the present invention. The embodiments described herein are thus intended to be illustrative, and not limiting. The scope of the invention is thus to be determined by having reference to the appended claims.

What is claimed is:

1. A handle engaging device for an object having a handle to be gripped comprising:

a first panel and a second panel formed from a core layer of resilient foam material of a predetermined thickness, said first and second panels abutting each other at an inner long-edge of each panel, and each having an outer short edge and two side edges defining a shape of the panel, said first and second panels being capable of being folded at or about said abutting inner long edges to an operational position wherein said first and second panels are substantially mutually parallel with inner facing surfaces and outer exposed surfaces, said inner facing surfaces being in contact along substantially an entire length thereof;

said first panel and said second panel being so constructed and arranged to capture handles of a bag therebetween when said first and second panels are folded into said operational position;

said device further having a thumb brace surface formed by side edges of each of said first and second panels.

2. A device as recited in claim 1 wherein said device, in said operational position, forms a brace portion for a heel of a hand, said brace portion comprising said outer short edges of each of said first and second panels, which together form a substantially flat surface at an end of said device opposite said abutting inner long edges.

3. A device as recited in claim 1, wherein said core layer of resilient foam material has a cover layer of flexible material covering said core layer.

4. A device as recited in claim 3, wherein at least one outer exposed surface has indicia disposed thereon.

5. A device as recited in claim 1, wherein said core layer of resilient material comprises ethylene vinyl acetate foam.

6. A device as recited in claim 1, wherein said device has fastening means disposed on at least one panel, on an inner facing surface thereof, said fastening means being positioned to fasten said first panel to said second panel.

7. A handle engaging device for an object having a handle to be gripped comprising:

at least a first panel, a second panel, and a third panel formed from a core layer of resilient foam material of a predetermined thickness, said first and second panels abutting each other at an inner edge of each panel, and each of said first and second panels having an outer edge, said first panel terminating at its outer edge, and said outer edge of said second panel having said third panel extending from said outer edge, said third panel being of sufficient length such that, when said first and second panels are folded into an operational position wherein said panels are disposed parallel to each other, and having said outer edges thereof substantially aligned, said third panel is sized to be capable of being wrapped over the outer edge of said first panel and of extending along an outer surface of said first panel for a predetermined distance.

8. A device as recited in claim 7 wherein said device, in said operational position, forms a brace portion for a heel of a hand, said brace portion comprising the portion of said third panel wrapped over said first panel.

9. A device as recited in claim 7, wherein said core layer of resilient material has a cover layer of flexible material covering said core layer.

10. A device as recited in claim 9, wherein at least one outer exposed surface has indicia disposed thereon.

11. A device as recited in claim 7, wherein said core layer of resilient material comprises ethylene vinyl acetate foam.

12. A device as recited in claim 7, further comprising a fourth panel extending from an outer edge of said third panel, said fourth panel being of a length wherein said fourth panel is operable to wrap around said second panel in forming said device into said operational configuration.

13. A device as recited in claim 11, wherein a thickness of said core layer is in a range of about 1–10 mm.

14. A device as recited in claim 13, wherein a thickness of said core layer is in a range of about 2–4 mm.

15. A device as recited in claim 14, wherein said core layer comprises a plurality of plies of said foam.

* * * * *